United States Patent [19]

Harralson et al.

[11] 3,967,446

[45] July 6, 1976

[54] EXHAUST RELIEF SILENCING APPARATUS FOR MARINE PROPULSION SYSTEMS

[75] Inventors: Joseph H. Harralson; William F. Wurzbach, both of Oshkosh, Wis.

[73] Assignee: Brunswick Corporation, Skokie, Ill.

[22] Filed: Aug. 26, 1974

[21] Appl. No.: 500,634

[52] U.S. Cl. ..... 60/312; 115/17; 81/39; 115/.5 E

[51] Int. Cl.[2] ..... F02B 27/02; B63H 5/13; F01N 7/12

[58] Field of Search ..... 60/310, 312, 313, 314; 115/17, .5 E; 181/39

[56] References Cited

UNITED STATES PATENTS

| | | | |
|---|---|---|---|
| 3,045,423 | 7/1962 | Hulsebus | 60/312 |
| 3,254,484 | 6/1966 | Kopper | 60/312 |
| 3,310,022 | 3/1967 | Kollman | 60/310 |
| 3,367,311 | 2/1968 | Tenney | 60/314 |
| 3,577,952 | 5/1971 | Tado | 115/17 |

*Primary Examiner*—Douglas Hart
*Attorney, Agent, or Firm*—Andrus, Sceales, Starke & Sawall

[57] ABSTRACT

A tuned exhaust gas relief system for marine propulsion systems, for example an outboard motor, includes a lower drive shaft housing coupled to a two stroke engine by a pair of intermediate stacked exhaust extension plates. The housing directs the exhaust gas downwardly to a through-the-hub exhaust propeller for exit therethrough. With the unit in reverse or idling, exhaust gases are trapped within the housing. A pair of tuned exhaust relief passageways may be formed by cavities in the mating faces of the two extension plates with a pair of inlet openings in the lower wall of the bottom plate. A baffle member may overlie the inlet openings. The passageways define constant cross-sectional area channels which terminate in exhaust openings in the rear wall of the drive shaft housing. A resonant cavity, which may be integrally formed by mating recesses in the opposed faces of the extension plates, is in close spaced relation to each idle exhaust passageway. Connecting openings are distributed along the length of the common wall between the cavity and passageway. An exhaust housing within the drive shaft housing forms an exhaust expansion chamber of high acoustical impedance between the lower ends of the exhaust pipe means and the upper wall extension plate assembly. The idle exhaust passageways have a low acoustical impedance, so that the acoustical impedance mismatch between the chamber and the passageways attenuates the high frequency sounds. The idle exhaust passageways may transmit the half wave frequency and even multiplies thereof. The resonator cavity is selected to attenuate the particular half wave frequency, or an even multiple thereof, which because of physical space requirements may be present and not attenuated by the idle exhaust passageway means.

21 Claims; 8 Drawing Figures

EXHAUST RELIEF SILENCING APPARATUS FOR MARINE PROPULSION SYSTEMS

BACKGROUND OF THE INVENTION

This invention relates to an exhaust silencing apparatus for outboard motors and other marine propulsion apparatus.

Outboard motors are generally constructed with an internal combustion engine as the power head. Various exhaust systems are employed for the engine, some of which provide tuning for maximum power at wide open throttle conditions. One highly satisfactory system channels the exhaust through the propeller hub. In such constructions, exhaust pipes or passageways are projected downwardly through the drive shaft housing and terminate in a passage extending downwardly through the propeller unit for exhaust below the water level. A typical system is illustrated in U.S. Pat. No. 3,808,807. When the engine is idling, however, the lower end of the exhaust discharge passageway is submerged within the water, creating excessive back pressure conditions. Generally, a pressure release system is provided by allowing the exhaust gases to escape upwardly through the water into the drive shaft housing and then outwardly via an idle relief exhaust passageway provided in the upper portion of the drive shaft housing and terminating above the idle water line. Although such systems provide a satisfactory solution to the back pressure problem, such exhaust passageways have been a source of undesired and considerable noise under idle speed conditions.

SUMMARY OF THE PRESENT INVENTION

The present invention is particularly directed to a marine propulsion apparatus having a main exhaust through the lower unit of the apparatus in combination with an idle relief exhaust system through the upper portion of the drive shaft housing, including special means for minimizing noise generated as a result of the exhaust gases passing through the idle relief exhaust system. Generally, in accordance with the present invention, the idle relief exhaust passageway is especially formed with sound deadening means to reduce the noise generated as a result of passage of the exhaust gases. In a particularly novel aspect of the present invention, a resonant cavity or chamber is coupled to the idle relief exhaust passageway and designed to significantly reduce the noise level. The resonant chamber is formed immediately adjacent to the idle exhaust passageway and coupled thereto by a plurality of interconnected openings. The pressure sound waves flow into and from the resonant chamber in accordance with the exhaust pressure conditions. The chamber dimensions are such that resonance occurs at the frequency, or even multiples thereof, at which silencing is desired. Energy required to drive the oscillations in the resonant chamber is lost from the sound waves with a resulting attenuation of sound levels at those frequencies. The restricted openings provide damping of the pressure wave. The size of the chamber and the interconnection thereto all contribute to the sound deadening characteristics.

The invention is particularly effective in tuned exhaust systems wherein an exhaust pipe means terminates within an exhaust housing chamber for transfer and discharge of the exhaust gases through the lower end of the exhaust housing when underway. The housing chamber is formed with the idle exhaust passageway in an upper wall assembly. The exhaust housing chamber forms an exhaust expansion chamber of high acoustical impedance between the lower ends of the exhaust pipe means and the upper wall assembly. The idle exhaust passageway in the upper wall assembly has a low acoustical impedance, so that the resulting acoustical impedance mismatch between the chamber and passageway attenuates the high frequency sounds. The idle exhaust passageway may transmit the half wave frequency and even multiples thereof. The resonator chamber is selected to attenuate the particular half wave frequency, or an even multiple thereof, which, because of space restrictions, may be present and not attenuated by the tuned idle exhaust passageway.

In accordance with a further aspect of the invention, applicants found that a baffle means over the exhaust passageway inlets help to minimize the exhaust noise.

Within the broadest aspects of the present invention, applicants have also found that an apertured baffle plate located within the idle exhaust passageway results in a reduction in the noise level, although the adjacent resonant cavity has been found to provide highly superior results.

In particular when applied to a multiple-cylinder, tuned engine forming a part of an outboard motor, the drive shaft housing is coupled to the power head with a pair of intermediate stacked exhaust extension plates. The lower plate includes a pair of integrally cast exhaust pipes connected by appropriate passageways in the plates to a pair of exhaust channels from the engine. The exhaust pipes are selected for proper tuning of the engine. A pair of idle relief passageways are cast in the mating faces of the two extension plates with a pair of inlet openings in the lower wall of the bottom plate located, respectively, to the opposite sides of the exhaust tubes. An integral baffle member is formed overlying the inlet openings of the idle relief passageways. The top and bottom extension plates are cast with opposed mating recesses defining constant cross-sectional area idle exhaust passageways which terminate in exhaust openings or ports in the rear wall of the drive shaft housing. A resonant cavity is integrally formed by mating recesses in the opposed faces of the top and bottom wall in close spaced relation to the idle exhaust passageway. A plurality of openings are formed in the wall of the lower plate, with the openings distributed along the length of the idle exhaust passageway in aligned relation and communicating with the resonant cavity.

The tuned idle relief exhaust system described with the baffle and resonant cavity in the extension plates is readily adapted to commercial production, and significantly reduces the noise level particularly at idle. Further, the concept can be readily incorporated into the outboard motor construction without interfering with the necessary aesthetic presentation and thus is particularly adapted to practical implementation of the invention.

BRIEF DESCRIPTION OF THE DRAWING

The drawing furnished herewith illustrates the best mode presently contemplated by the inventors for carrying out the subject invention in which the above advantages and features are clearly disclosed as well as others which will be readily understood from the following description of the embodiments shown.

In the drawing.

DESCRIPTION OF ILLUSTRATED EMBODIMENTS

Figure 1:
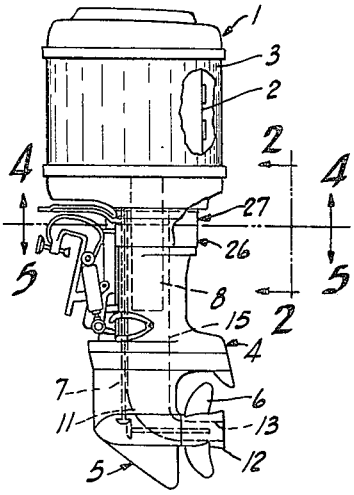
FIG. 1 is a side elevational view of an outboard motor constructed in accordance with the teaching of the present invention and with parts broken away to illustrate certain details of construction.
Figure 2:
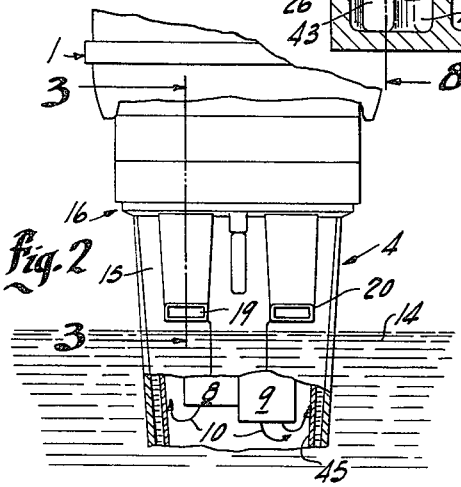
FIG. 2 is a fragmentary rear elevational view of the lower unit of the outboard motor taken generally on line 2—2 of FIG. 1.
Figure 3:
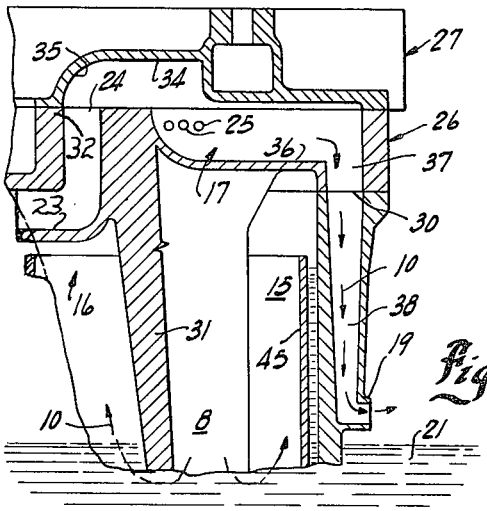
FIG. 3 is an enlarged fragmentary vertical view taken generally on line 3—3 of FIG. 2 and illustrates a tuned exhaust idle relief passageway formed by cavities in the mating faces of stacked exhaust extension plates.
Figure 6:
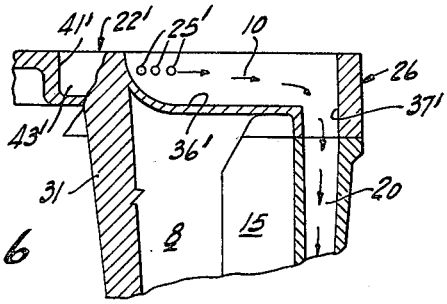
FIG. 6 is a vertical section taken generally on line 6—6 of FIG. 5.

Referring to the drawings and particularly to FIG. 1, an outboard motor is illustrated including an upper power head 1 having an internal combustion engine 2 mounted within a cowl 3. The engine 2 and cowl 3 are supported upon the upper end of a drive shaft housing 4 with an underwater lower unit 5 secured and carried by the bottom end of the drive shaft housing. A propeller 6 is rotatably supported by the lower unit 5 and a drive shaft 7 extends through the forward portion of the housing 4 and unit 5 to connect the output of the engine to the propeller drive gear means within the lower unit 5. In the illustrated embodiment of the invention, the engine 2 is assumed to have six cylinders divided into two groups of 3 for exhaust purposes. A pair of tuned exhaust systems terminating in a pair of exhaust tubes 8 and 9 extend downwardly through the aft portion of the drive shaft housing 4. The exhaust tubes 8 and 9 are selected of a desired length which in combination with the exhaust passageways within the engine, not shown, provide a tuned exhaust system for the engine; normally for a wide open throttle condition. The exhaust gases 10, as shown in FIGS. 1 – 3, flow downwardly from the exhaust tubes 8 and 9 through the drive shaft housing 4 and exit through an exhaust passageway 11 formed in the lower unit 5. Passageway 11 extends outwardly through the propeller hub 12 and the exhaust gases discharge through a nozzle opening 13 to the rear portion of the outboard motor under normal operating propulsion conditions. Such systems provide for minimizing of the back pressure under operating conditions as a result of the high speed rotation of the propeller and contributes to the efficient exhausting of the exhaust gases.

Figure 4:
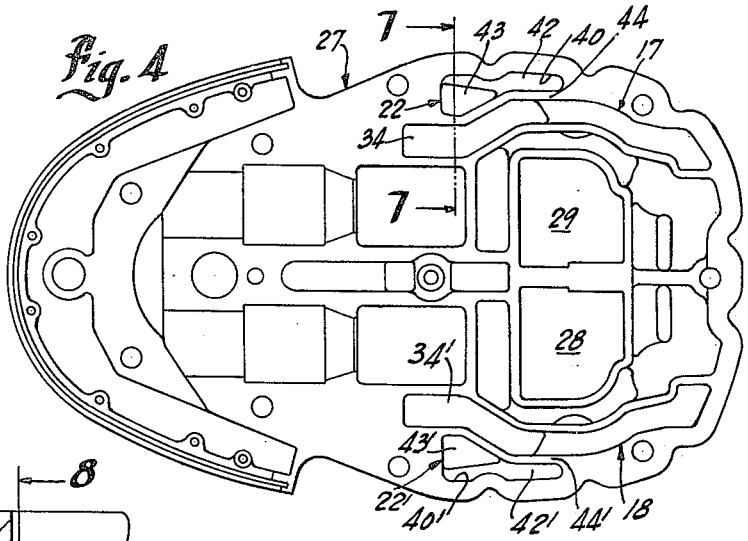
FIG. 4 is a horizontal section through the outboard motor taken on line 4—4 of FIG. 1 and showing the bottom side of the upper exhaust extension plate.
Figure 5:
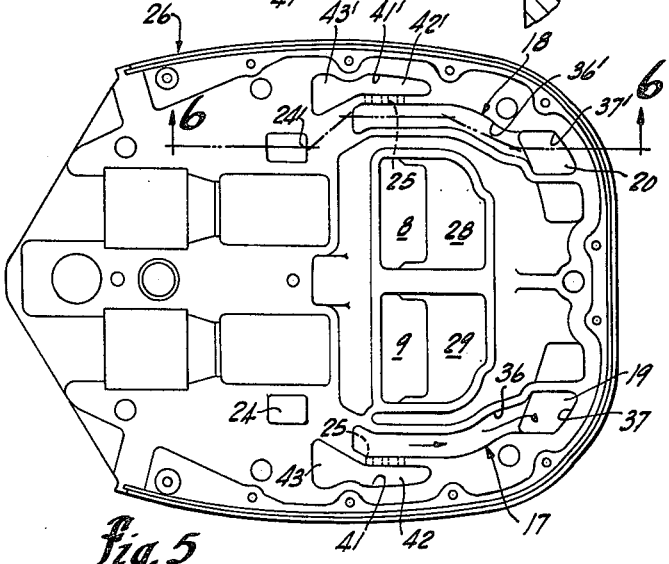
FIG. 5 is a horizontal section taken generally on line 5—5 of FIG. 1 and showing the top side of the lower extension plate.

However, under low speed or idle conditions, the lower unit 5 is submerged within the surrounding water 14 as shown in FIGS. 2 and 3, and the water will extend upwardly into the exhaust passageway 11 and cover the lowermost end of the exhaust tubes 8 and 9. Under such conditions, the exhaust gases 10 and partially trapped upstream of the exhaust tubes 8 and 9, resulting in back pressure conditions. Generally, the exhaust gases 10 will escape upwardly through the water 14, as shown by dotted exhaust gas lines 10, into the drive shaft chambers 15 between the water level and the upper end wall means 16 of the drive shaft housing 4. A pair of novel idle relief exhaust passageways 17 and 18, which particularly illustrate the subject matter of this invention, are provided in the upper wall means 16 of the drive shaft housing to direct the idle exhaust gases therefrom. Generally, the relief exhaust passageways 17 and 18 similarly extend rearwardly through the wall means 16 and terminate in a pair of exhaust ports 19 and 20 located immediately above the normal water level 21 at idle conditions. In accordance with the present invention, the exhaust passageways 17 and 18 are provided with sound damping means, to reduce and minimize the noise created by passage of the exhaust gases to atmosphere. Each of the special relief exhaust passageways 17 and 18, in the illustrated embodiment of the invention, is identically constructed to the laterally opposite sides of the drive shaft housing 4 and particularly to the opposite side of the exhaust tubes 8 and 9, as shown in FIGS. 4 and 5. Only the passageway 17 shown to the left side of the assembly in FIG. 2 is described in detail and the corresponding elements of the passageway 18 are identified by corresponding primed numbers.

In the illustrated embodiment of the invention, the damping means include a side branch resonator chamber 22 coupled to idle exhaust passageway 17, and a sound deadening baffle means 23 interposed across the opening 24 to the relief exhaust passageway 17. The side resonating chamber 22 is coupled to the idle exhaust passageway 17 by a plurality of spaced openings 25 which provide a restrictive flow of the exhaust gases 10 into and from the chamber 22. This results in a dampening of the pressure waves and the resultant silencing of the exhaust at idle. The baffle means 23 prevents direct passage of the idle exhaust gases 10 and further contributes to the damping of the pressure waves and therefore the silencing of the usual noise.

More particularly, in the illustrated embodiment of the invention, the upper wall means 16 includes a pair of exhaust extension plates 26 and 27 which are arranged in stacked relation between the engine 2 and the uppermost end of the drive shaft housing 4. The bottom or lower plate 26 is constructed with the exhaust tubes 8 and 9 integrally cast therewith. The bottom and upper plates 26 and 27 having corresponding aligned openings 28 and 29 between tubes 8 and 9 and the lower end of the manifold exhaust passageways, not shown, of the engine 2.

The engine extension plates and drive shaft housing are interconnected by suitable means to form a pair of continuous tuned exhaust passageways for efficient exhausting of the gases 10 through the propeller 6 when the propeller is engaged and the engine is moving through the water.

The illustrated idle exhaust passageways 17 and 18 may be formed in the top and bottom plates 26 and 27 by suitable mating cast cavities in the opposite mating faces thereof, as follows.

Referring particularly to FIGS. 3 and 5, the bottom plate 26 is generally a cast member having a bottom planar surface 30 resting in sealing engagement upon the upper end of a correspondingly configured top wall of the drive shaft housing 4. The exhaust openings and tubes 8 and 9 are located in the rear central portion of the plate 26 and extend downwardly into housing 4. The plate member 26 is cored-out to reduce the total weight thereof and, in accordance with the illustrated embodiment of the invention, includes a cored-out portion adjacent the forward wall 31 of the exhaust tube 8 to define a relatively thin upper wall portion 32 in the upper plane of the bottom plate 26. The exhaust inlet opening 24 of the passageway 17 is formed within such wall.

In accordance with the present invention, the baffle plate 23 is integrally cast within the cored-out portion of the lower plate 26 in downwardly spaced relation to the opening 24. The baffle 23 permits the upward flow of exhaust gases 10 around the edges of the baffle plate into and through the exhaust inlet opening 24, as most clearly shown in FIG. 3.

The bottom surface of the upper extension plate 27 is cored and particularly formed with an upper passageway cavity 34 having one end aligned with opening 24 defining the upper portion of the exhaust passageway 17, as shown in FIGS. 3 and 4. Cavity 34 extends rearwardly with a slight horizontal outward or lateral bend in the central portion around the opening 28, as most clearly shown in FIG. 4. The cavity 17 has a generally rectangular cross section at the inlet opening 24 with a curved end wall 35 aligned with the inlet opening to smoothly direct the rising exhaust gases horizontally and rearwardly through the exhaust passageway 17. Cavity 34 extends rearwardly over an intermediate top wall surface of bottom plate 26 and terminates in superimposed relation to the aft end of a generally rectangular cavity 36 which extends rearwardy in the top wall of the bottom plate 26, as shown most clearly in FIGS. 3, 4 and 5. The cavity extends rearwardly and terminates in the rearmost portion in a downwardly directed opening or passage 37. The drive shaft housing 4 has an aligned opening 38 terminating in the exhaust port 19. The top plate 27 is also slightly relieved along the extent of the cavity 36 of bottom plate 26, as most clearly shown in FIG. 3. The mating plates 26 and 27 thus define an exhaust passageway 17 of an essentially constant cross sectional area.

Figure 7:
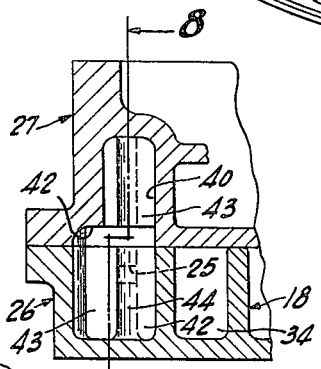
FIG. 7 is a fragmentary sectional view taken generally on line 7—7 of FIG. 4 and through the stacked exhaust extension plates of FIGS. 4 and 5 to more clearly show the cross-section of the relief passageways.
Figure 8:
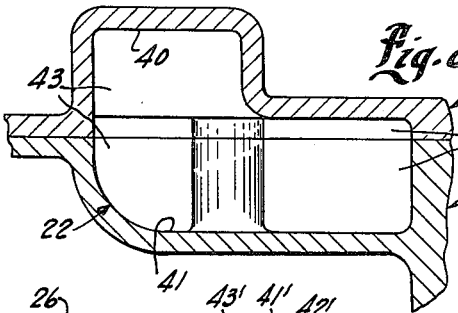
FIG. 8 is a view taken on line 8—8 of FIG. 7.

In accordance with the teaching of the present invention, the resonator chamber 22 is formed by a pair of mating cavities 40 and 41, most clearly shown in FIGS. 7 and 8, in the top and bottom plates 26 and 27 immediately adjacent to the passageway 17, and particularly the inlet portion thereof.

The resonator chamber 22, as viewed in FIG. 4 or 5 is provided with a relatively narrow rectangular aft portion 42 extending adjacent to the exhaust passageway 17 and a slightly enlarged triangular forward portion 43 located forwardly thereof. The enlarged portion 43 is located adjacent the inlet end or portion of the idle exhaust passageway 17 which is set generally into alignment with the outer side of the exhaust extension opening and provide adequate space for portion 43. The portion 42 is located in lateral alignment with the extension opening and thus is formed as a narrow chamber extension within the limited space.

As shown in FIGS. 4, 7 and 8, the cavity 41 in the upper plate 27 has the enlarged portion 43 of a depth similar to the passageway 17 but the narrow portion 42 is only a slight depth. As shown in FIGS. 5 and 7, the cavity 43 in the bottom plate 26 has a constant depth which is slightly deeper than the idle exhaust passageway cavity 36, and extends throughout both portions 42 and 43. The wall 44, separating the passageway 36 from the cavity 41 is relatively thin and is provided with the plurality of integrally cast apertures or openings 25. For optimum results applicants have found the openings 25 should be limited in number and spaced longitudinally along the length of the exhaust passageway 17 and the resonant cavity 22.

Under idle conditions, the exhaust gases 10 pass upwardly around baffle 23, through the inlet opening 24 into the exhaust passageway cavity 34 in the top plate 27 and then downwardly into the extension cavity 36 in the lower plate 26, where the exhaust gases are coupled by openings 25 to cavity 22.

The small openings 25 between the exhaust passageway 17 and the resonant cavity 22 provide a resonant action and damping of the pressure waves. The size and number of the openings between the main passageway 17 and the resonant cavity 22, as well as the volume of the resonant cavity 22, all contribute to creation of an optimum silencing characteristic for any given system. Generally, the size of the cavity 22 will be dictated by the available space within the housing. However, the total optimum condition can be readily determined by simple emperical construction of the cavity with variations in the number and location of the openings.

The resonant cavity and openings ace act a side branch resonator. The theory of operation is analogous to that of a machanical vibration absorber. By tuning the resonator to a frequency which is the same or an even multiple of the driving frequency (i.e. the undesired sound frequency) the energy of the sound is used to drive the oscillations of the resonant cavity and thus the sound pressure level at the exit from the engine is reduced. By considering the resonant cavity and openings as a helmholtz resonator, it is possible to calculate the required physical dimensions for a particular frequency.

As previously set forth, the invention is particularly effective when utilized in tuned exhaust system such as in the illustrated embodiment. Chamber 15 within the exhaust housing 4 forms an exhaust gas expansion chamber of a high acoustical impedance. The idle exhaust passageway 17 is formed as a low frequency resonator, which, in the illustrated embodiment, particularly results from the constant cross section and narrow width. The acoustical mismatch between the chamber 15 and the passageway 17 results in effective attenuation of essentially all higher frequencies, with increased attenuation of essentially all frequencies above the resonant frequency of the tuned idle exhaust passageway. The resonant frequency is not as fully attenuated by the mismatch and resonant idle exhaust passageway, but the side branch resonator chamber is selected to essentially remove this sound source. In practice, the first even multiple was selected to permit use of a practical cavity size. Thus, for a six cylinder high speed outboard engine with a tuned exhaust, the total exhaust flow length was about 13 inches and dips in the attenuation occurred at multiples of 500 Hertz (Hz). A resonant chamber for this frequency could be formed conveniently with the adaptor or extension plates. Applicants found that essentially similar results were obtained by tuning the side branch resonator to the even multiple of the resonant frequency which permitted a convenient sized chamber. Thus, for the described example, tuning to 1,000 Hz reduced the required chamber volume to 1.2 cubic inches which was readily cast into the extension plates 26 and 27 without interference with the desired overall configuration of the outboard.

The combination of the resonant cavity 22 and the input baffle plate 23 provides a highly improved idle exhaust system with a very significant reduction in the noise level.

Other damping methods might be employed in accordance with the broad aspects of the present invention to obtain a similar or a deadening noise reduction. However, none have been found to provide as effective a result as the side branch resonators and the inlet bafflers. For example, a baffle over the upper end of the exhaust tube 45 which is suitably supported within the drive shaft housing produces significant noise reduction. Applicants have found that the baffle plate over the inlet openings to the idler exhaust passageway provides essentially the same results while significantly minimizing the manufacturing and casting processes and procedures. Further, sound deadening is obtained by merely introducing an apertured baffle plate directly across the direct flow path of the idle exhaust passageway but such a system is significantly inferior to the resonant cavity construction of the present invention.

The present invention thus provides a practical marine engine tuned idle relief exhaust system for minimizing exhaust noise under idle conditions.

Various modes of carrying out the invention are contemplated as being within the scope of the following claims, particularly pointing out and distinctly claiming the subject matter which is regarded as the invention.

We claim:

1. In an outboard propulsion unit including an exhaust housing means having a main exhaust passageway means terminating in a main exhaust nozzle means for discharging of exhaust gases, said main exhaust nozzle means being below the idle water line whereby water moves into the main exhaust passageway means and creates a back pressure condition in said exhaust passageway means at idle, an idle exhaust passageway means communicating with the main exhaust passageway means and terminating in exhaust port means to provide essentially unrestricted flow therefrom, said idle exhaust passageway means including silencing means having a resonator cavity means located adjacent to said idle exhaust passageway means and connected thereto by at least one opening and operable to modify the flow of exhaust gases through the idle exhaust passageway means and limit the pressure waves therein caused by engine operation.

2. The propulsion unit of claim 1 wherein the silencing means includes baffle plate means located in overlying relationship to the entrance to said idle exhaust passageway means.

3. The propulsion unit of claim 1 wherein said idle exhaust passageway means has an essentially constant cross-section.

4. The propulsion unit of claim 3 wherein said idle exhaust passageway means has a rectangular cross-section including a narrow extending passageway to attenuate high frequency pressure waves.

5. The outboard propulsion unit of claim 1 having a multiple cylinder engine with a pair of said idle exhaust passageway means with individual silencing means and wherein each of said silencing means includes a resonator cavity means located adjacent to said exhaust passageway means and connected thereto by a plurality of restricted flow openings.

6. The outboard propulsion unit of claim 1 wherein said housing means has an upper exhaust passageway wall assembly located above the water line and said idle exhaust passageway means is located within said wall assembly and includes an inlet opening to the upper portion of said main exhaust passageway means, said silencing means being located in said wall assembly.

7. The outboard propulsion unit of claim 6 having a tuned exhaust system including main exhaust pipe means terminating within said exhaust housing in downwardly spaced relation to said upper wall assembly, the housing defining an expansion chamber of high acoustical impedance between the lower ends of the exhaust pipe means and the upper wall assembly, and said idle exhaust passageway means forming a finite length low acoustical impedance passage, so that an impedance mismatch is created in the idle exhaust system to minimize sound power transfer.

8. The propulsion unit of claim 7 wherein said idle exhaust passageway means has a uniform, narrow width to reduce the resonant frequency and increase attenuation of high frequencies, said idle exhaust passageway means having negative attenuation at half-waves and multiples thereof, said resonator cavity means being tuned to a low even multiple of said half-wave frequency.

9. The propulsion unit of claim 8 wherein said resonator chamber is tuned for a resonance frequency of 1000 hertz.

10. The outboard propulsion unit of claim 6 wherein said wall assembly includes a top and a bottom plate means mounted in abutting relation upon the upper end of said exhaust housing means, said top plate means being adapted to support an internal combustion engine having an exhaust manifold means terminating in the upper face of said top plate means, said plate means having a centrally located exhaust extension opening means and said bottom plate means having a depending exhaust pipe means, said idle exhaust passageway means being located at the interface of said plate means, and extending about the outer side of said exhaust extension opening means, said resonator cavity means being located adjacent the one side of said idle exhaust passageway means and coupled thereto by a plurality of lateral opening means.

11. The outboard propulsion unit of claim 10 wherein said exhaust manifold means and extension opening means and pipe means include a pair of side-by-side main exhaust passageways defining a tuned exhaust system, said idle exhaust passageway means includes a pair of idle exhaust passageways correspondingly located to the opposite sides of said main exhaust passageways, each of said idle exhaust passageways including an inlet opening located in the bottom surface of the bottom plate means and generally in alignment with the outer side of the extension opening means, said idle exhaust passageway extending rearwardly from said inlet opening in close-spaced relation to said extension opening means and terminating behind said extension opening means in alignment with the inlet opening, a separate resonator cavity means for each idle exhaust passageway means located immediately outwardly of the corresponding idle exhaust passageway means, each of said cavity means including an enlarged forward portion located adjacent the forward portion of the idle exhaust passageway means and a narrow portion located adjacent the portion laterally aligned with the extension opening means, coupling openings located in the wall adjacent the narrow portion.

12. The outboard propulsion unit of claim 6 including a lower unit having an exhaust nozzle means and secured to the lower end of the housing means and an internal combustion engine mounted on said upper wall assembly, a tuned exhaust pipe means secured to the upper wall assembly and extending downwardly through said exhaust housing and terminating in upwardly spaced relation to said lower unit to discharge the exhaust gases into the housing for discharging of the exhaust gases through said nozzle means below the water from the lowermost end of the unit, the lower end of said exhaust pipe means extending below the idle water line of the housing, said idle exhaust passageway means including an inlet opening forwardly of the pipe means and extending rearwardly about the pipe means and then downwardly through said housing and terminating in said exhaust port means located above the idle water line of the unit, said resonator cavity means coupled by restricted opening means to the idle exhaust passageway means to reduce the pulsation of the pressure waves at the exhaust ports as a result of engine operation.

13. The outboard propulsion unit of claim 12 including a baffle plate located in overlying downwardly spaced relation to said inlet opening.

14. In the outboard propulsion unit of claim 1 wherein said exhaust housing means includes a lower drive shaft housing secured to a lower propeller unit having an exhaust nozzle concentrically of the propeller unit for discharging of the exhaust gases through the propeller unit, said housing means having an upper wall assembly including a pair of plates including mating cavities forming said idle exhaust passageway means, said cavity means located adjacent the idle exhaust passageway means and coupled thereto by a plurality of longitudinally spaced openings spaced in the direction of the exhaust gas flow.

15. The outboard propulsion unit of claim 14 includes a pair of said idle exhaust passageway means, each of said passageways having a similar cavity means.

16. The outboard propulsion unit of claim 14 wherein said idle exhaust passageway means is an elongated passageway and said resonator cavity means is a parallel narrow cavity coupled to the central portion of said idle exhaust passageway means by said plurality of openings.

17. The apparatus of claim 16 having a pair of tuned exhaust systems and a pair of said idle exhaust passageway means including separate resonator cavities, each of said cavities having a volume of approximately 1.2 cubic inches and coupled to the exhaust passageway means by three openings of about ⅛ inch diameter.

18. The outboard propulsion unit of claim 16 wherein the silencing means includes baffle plate means located in overlying relationship to the entrance to said idle exhaust passageway means.

19. In a marine propulsion unit including an engine, a propelling element, a drive train connecting said engine and propelling element and a housing for said drive train including a main exhaust passageway therethrough, said housing and the main exhaust outlet therein normally extending below the water, means for relieving exhaust pressure within said main exhaust system primarily where said unit is at idle or in reverse comprising a channel of preselected cross-sectional area and length venting said main exhaust passageway to the atmosphere, the dimensions of said channel being selected to attenuate selected audio frequencies, and a side branch resonating cavity connected to said channel having dimensions selected to attenuate selected audio frequencies.

20. The device of claim 18 wherein said main exhaust passageway includes an expansion chamber and the inner end of said exhaust pressure relieving channel is open to said chamber.

21. The device of claim 19 including a plurality of said channels and connected cavities each of substantially identical dimensions.

* * * * *

UNITED STATES PATENT AND TRADEMARK OFFICE

CERTIFICATE OF CORRECTION

PATENT NO. : 3,967,446

DATED : July 6, 1976

INVENTOR(S) : JOSEPH H. HARRALSON ET AL

It is certified that error appears in the above-identified patent and that said Letters Patent are hereby corrected as shown below:

| | | | | |
|---|---|---|---|---|
| Column | 3, | Line | 67, | after "10" cancel "and" and insert --- are ---; |
| Column | 6, | Line | 26, | after "openings" cancel "ace"; and after "act" insert --- as ---; |
| Column | 6, | Line | 60, | after "could" insert --- not ---. |

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*